United States Patent [19]

Eckert, Jr. et al.

[11] 4,377,739

[45] Mar. 22, 1983

[54] AVERAGE POWER CONTROL APPARATUS AND METHOD

[75] Inventors: Alton B. Eckert, Jr., Norwalk; Wayne W. Pritchett, Newtown, both of Conn.

[73] Assignee: Pitney Bowes Inc., Stamford, Conn.

[21] Appl. No.: 55,435

[22] Filed: Jul. 6, 1979

Related U.S. Application Data

[63] Continuation of Ser. No. 869,465, Jan. 16, 1978, abandoned.

[51] Int. Cl.[3] ..... H05B 1/02

[52] U.S. Cl. ..... 219/497; 219/216; 219/492; 219/505; 219/489; 307/252 UA; 323/235

[58] Field of Search ..... 219/216, 492, 494, 497, 219/501, 505, 509, 489; 307/117, 252 UA; 323/18, 19, 22 SC, 24

[56] References Cited

U.S. PATENT DOCUMENTS

| | | | |
|---|---|---|---|
| 3,532,855 | 10/1970 | Van Cleave | 219/497 X |
| 3,553,428 | 1/1971 | McGhee | 219/501 |
| 3,584,291 | 6/1971 | Budniak et al. | 219/494 |
| 3,651,753 | 3/1972 | Schmidt | 219/501 |
| 3,878,358 | 4/1975 | Baston et al. | 219/216 |
| 3,925,688 | 12/1975 | Kalfus | 323/18 |
| 3,937,921 | 2/1976 | Furuichi et al. | 219/501 |
| 4,010,412 | 3/1977 | Forman | 219/486 |
| 4,029,937 | 6/1977 | Russell | 307/117 |
| 4,086,466 | 4/1978 | Scharlack | 219/501 |

*Primary Examiner*—Bruce A. Reynolds
*Assistant Examiner*—M. H. Paschall
*Attorney, Agent, or Firm*—Donald P. Walker; Albert W. Scribner; William D. Soltow, Jr.

[57] ABSTRACT

A power control method and apparatus maintains a constant average power at an electrical load, such as a fuser in an electrophotocopy machine. A power monitor measures the average power delivered to the load and compares the measured power to a predetermined power. A digital network receives an input signal from the power monitor and controls the coupling of power from an ac source to the load. When load power is less than a predetermined level, the digital network couples every half cycle of the ac power source to the load. When the load power is equal to or greater than the predetermined power, the digital network couples every third ac half cycle to the load. As a result, only half cycles of sequentially opposite polarity are coupled to the load.

2 Claims, 4 Drawing Figures

AVERAGE POWER CONTROL APPARATUS AND METHOD

This is a continuation of application Ser. No. 869,465, filed Jan. 16, 1978 for the same invention now abandoned.

BACKGROUND OF THE INVENTION

This invention relates to an average power control circuit, and more particularly to a logic circuit including analog and digital elements for gating a constant average power to an electrical load, such as a radiant energy fuser in an electrophotocopy machine.

It is desirable to accurately control the power delivered to an electrically powered heating load, especially when the heating load is a radiant energy fuser in an electrophotocopy machine. Such a fuser operates in a warm up mode, an idle mode and a fusing mode. There are a number of devices controlling the fuser during each mode of operation. Such devices range from simple thermostatic control to complex systems including thermal sensors and electronic circuits.

A problem with power controls is the generation of spurious radiation or noise. Sophisticated copy machines often contain a number of electronic components and noise will adversely interfere with the performance of such components. Noise will be generated whenever an ac power source is switched to the fuser unless the instantaneous value of ac voltage is near zero. Accordingly, it is desirable and known in the art to apply or interrupt power to the fuser when the instantaneous values of voltage and current are changing polarity, i.e., at their zero cross-over point. See, for example, U.S. Pat. No. 3,878,358 where a zero cross-over controlled fuser power supply is discussed.

It is also desirable to maintain the power applied to the fuser at a constant average value. By doing so, a precise idle temperature and fusing temperature can be maintained so that uniformly fused copies can be produced. However, it is difficult to accomplish this desirable result because voltage supplied by a utility company is not constant, and varies under the influence of factors beyond the precise control needed for optimum fusing consistency.

It is still further desirable to switch an even number of positive and negative ac half cycles to a fuser because an excess number of positive or negative half cycles will result in a net dc voltage delivered to the fuser. A net dc voltage will cause saturation in transformers in the electrophotocopy machine and in the utility supply line. Saturated transformers may overheat and otherwise malfunction thereby adversely affecting the electrophotocopy machine itself as well as other equipment that draws its electrical power from the same source as the machine.

It is especially important to control the power delivered to a focused radiant energy fuser. Such devices typically comprise a source of radiant energy and a shaped reflector. The reflector focuses the radiation on a narrow line of focus that is transverse to the path of a copy sheet bearing unfused toner particles. Those particles are melted and thereby permanently fixed to the copy sheet as they pass the line of focus. Slight fluctuations in the average power delivered to such a fuser may cause banding, i.e., transverse strips of inconsistently fused particles on the copy sheet. Accordingly, it is desirable to keep the average power delivered to the fuser at a nearly constant level in order to minimize or eliminate banding.

SUMMARY OF THE INVENTION

This invention is a control apparatus for selectively applying power to an electrical load from an ac power source in accordance with the changes in polarity of the voltage or current of the ac source.

The control apparatus of this invention includes a means for gating power to an electrical heating load in order to supply a predetermined constant average power to the heating load from a continuously varying ac power source. The invention controls both the polarity and quantity of ac half cycles that are gated from an ac source to a heating load.

The dc saturation of transformers, spurious radiation and output power fluctuations (which result in radiant ripple in a fuser) can be avoided or minimized if ac power is delivered to a heat source under the following conditions:

(1) every positive ac half cycle will be followed by a negative half cycle, and (2) at least every third ac half cycle is delivered to the heat source, i.e., not eliminating more than one full ac cycle.

In accordance with the foregoing discovery, this invention has means for selectively gating only ac half cycles of sequentially opposite polarity and for gating at least one of every three ac half cycles in order to deliver a constant average power to the heating load. In other words, there are means for gating power for at least a half cycle whenever power has not been transmitted for a full cycle. As a result, power is never interrupted for more than one full cycle, output power ripple is minimized and a constant average power, free from generation of spurious radiation, is applied to the heat source.

More specifically, the invention comprises a control system composed of interconnected clock, power monitor and digital networks. The power monitor network measures the instantaneous level of average power gated to the heating load and compares the average power level to a predetermined constant average power level. When the gated average power level drops below the predetermined power level, the power monitor network sends a digital power request signal to the digital network. The power request signal will either call for all of the available power or for every third ac half cycle. The digital network controls the gate of a firing device, such as a triac, that connects the ac power supply to the heating load. The digital circuit delivers one of two series of output pulses to the triac gate in accordance with the power request signal from the power monitor network. When there is a request for power signal from the power monitor network, the digital network has an output pulse for each half cycle of the ac source, so that all of the available power is coupled to the heat source. When the average power delivered to the heat source reaches or exceeds a predetermined level, the request for power signal terminates and the digital network generates an output pulse for every third ac half cycle. By gating every third ac half cycle, and by gating only sequential half cycles of opposite polarity, dc saturation of power line and copy machine transformers is prevented. Since the heating source average power is constantly monitored and adjustable every ac half cycle, there is a minimal fluctuation in the average power delivered to the heating source.

The clock network includes a clock pulse generator, a full wave rectifier, and a zero crossing pulse generator. The clock pulse generator comprises a square pulse generator and a flip flop that are connected across the line voltage for deriving several clock pulse outputs for the digital network. The zero crossing pulse generator is also driven by the line voltage and has an output series of pulses, each pulse representative of when the line voltage changes polarity, i.e., crosses zero. The output signals of the clock network are coupled to the digital network to synchronize its operation with the power monitor network.

The power monitor network comprises a number of analog circuits for deriving a signal representative of the power delivered to the heat source, averaging the derived power signal and comparing the level of the average power to a predetermined level representative of a desired power value, and for generating a digital request for power signal when the average power signal level falls below the predetermined level.

The first circuit in the power monitor network is a gating circuit. The gating circuit receives one input signal representative of the power supply (line) voltage, and another input pulse signal representative of each time an ac half cycle is applied to the heating load. The input pulses gate the signal representative of the line voltage to the output of the gating circuit, so the output is a signal representative of the voltage applied to the heating load. The heating load voltage signal is coupled to an analog squaring circuit in order to derive a signal representative of power delivered to the heat source. This is possible because the power (P) is the product of voltage (E) and current (I); $P=EI$. Since $I=E/R$ (resistance) and R is a constant, power is proportional to the square of voltage. The voltage squared (power) signal is coupled to an averaging circuit in order to further derive a dc signal whose level is representative of average heat source power. The average power signal is fed into a comparator where it is compared with a dc signal level representative of desired average power. When the average power signal level falls below the predetermined level, the comparator has an output. The output of the comparator is fed into a pulse generator to yield a digital power request signal. When the average power level equals or exceeds the predetermined level, the power request signal terminates. The power request signal along with the clock signals and zero crossing pulse signals are fed into the digital circuit in a manner described in more detail hereinafter.

The foregoing is a description of one method and apparatus for measuring heating load power. Those skilled in the art will recognize that there are other methods and apparatus for the same purpose. For example, it is also possible to measure power by coupling a current transformer between the firing device and the heating source in order to derive a signal representative of heating source current. The signals representing heating source voltage and current could be fed into a multiplier which would have an output signal representative of the product of the input signals, i.e., representative of $ExI=P$, instantaneous power. The instantaneous power signal could then be averaged and compared to the predetermined dc level. As an alternative, one could also substitute a load current representative signal for the load voltage representative signal in the circuit of the preferred embodiment since instantaneous power is also proportional to current squared.

Regardless of the means or method that is used to derive a request for power signal, the digital network that receives the request for power signal comprises a coincidence digital circuit and a firing pulse regulation circuit. The coincidence circuit controls the polarity of ac half cycles that may be gated to the heating source. The output of the coincidence circuit is coupled to the firing pulse regulation circuit that controls the number of ac half cycles that are gated to the heating source. In this regard, the firing pulse regulator may yield an output firing pulse if and only if the polarity of the present ac half cycle is opposite to the polarity of the last gated ac half cycle. The input signals to the coincidence circuit include a feedback signal of the output of the firing pulse regulation circuit and several clock signals derived from the clock network. Those coincidence circuit inputs serve as a memory for the coincidence circuit of the polarity of the last half cycle of line voltage that was gated to the heating load. The coincidence circuit compares the polarity of the last half cycle of ac voltage that was applied to the heating load to the polarity of the present half cycle of ac voltage. If the polarities coincide, the present half cycle is not gated; if the polarities differ, the present half cycle may be gated, if the firing pulse regulation circuit so determines.

The firing pulse regulator is a digital circuit that receives as input signals the power request signal from the power monitor and the output signal of the coincidence circuit, zero crossing pulses, clock signals, and a feedback signal representative of the last output of the firing pulse reguator itself. The output of the firing pulse regulator is connected to the gate of a firing device, such as a triac, that is interposed between the power supply and the heating source. Upon receipt of a pulse signal at the gate, the triac will become conductive for one half ac cycle. In the absence of a pulse, the triac behaves like an open circuit. As mentioned above, the firing pulse regulator circuit controls the number of ac half cycles that are gated to the heating source. To this end, when there is a request for power signal from the power monitor, there is a coincidence circuit output for every ac half cycle and the firing pulse regulator will have an output firing pulse for each ac half cycle. When the request for power signal terminates, the coincidence circuit and the firing pulse regulator cooperate to gate every third ac half cycle, i.e., ac half cycles of sequentially opposite polarity.

The above described power control apparatus may further comprise controls for operating the heating source in an idle mode during which less than all of the predetermined constant average power is required. An idle control network comprises a thermostat for sensing the temperature of the heat source and an idle pulse counter circuit for intercepting the firing pulses and gating only a predetermined percentage of the intercepted pulses to the triac firing device. The invention also includes means for interrupting all power delivery to the heating source if there is a malfunction, such as a paper jam in the fuser.

Accordingly, it is an object of this invention to provide a means and method for delivering a constant average power to a heat source. It is a further object of this invention to provide a means and method for delivering a constant average power to a heat source with a minimum of spurious radiation.

It is another object of this invention to provide an analog and digital apparatus and method for selectively gating line power to a focused radiant energy fuser during half cycles of line voltage of sequentially opposite polarity with no more than one full cycle of line voltage elapsing between gated half cycles.

The invention, its objects and its embodiment will become clear upon reading the following description in conjunction with the drawings identified below.

DESCRIPTION OF THE PREFERRED EMBODIMENTS

Figure 1:
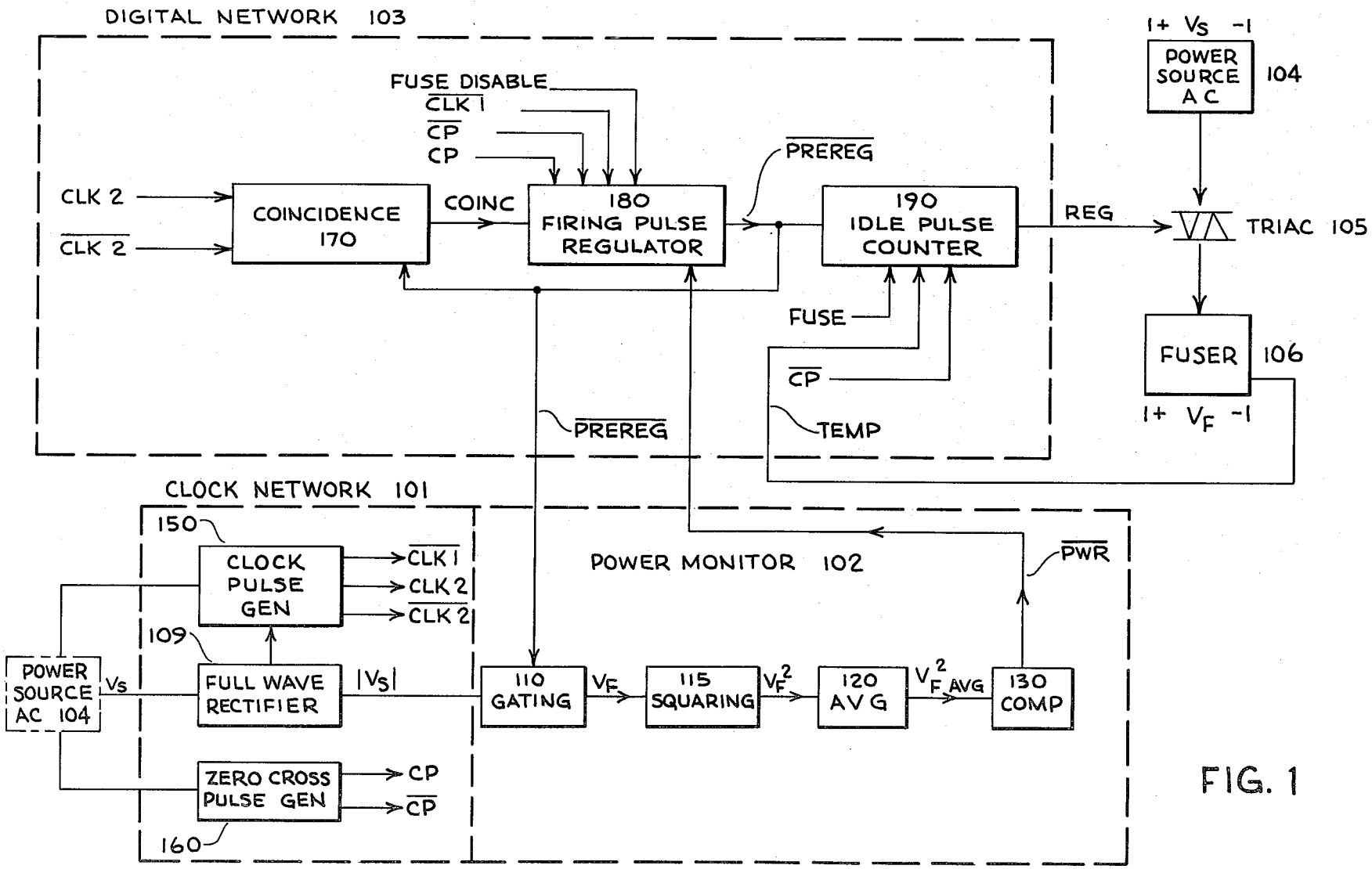
FIG. 1 is a schematic block diagram of an illustration of an embodiment of the principles of this invention.

Turning to FIG. 1, there is shown a block diagram schematic illustration of the preferred embodiment. An ac power source 104 is coupled to a radiant energy fuser 106 through a triac 105. The triac 105 is connected to the output of firing pulse regulator via an idle pulse counter 190 which normally transmits all firing pulses to the triac 105. Accordingly, the triac 105 becomes conductive for an ac half cycle whenever a firing pulse is passed to the triac 105 by the firing pulse regulator 180.

The principles of this invention are implemented by the clock network 101, the power monitor network 102 and the digital network 103. The power monitor 102 comprises four serially connected elements including a gating circuit 110, squaring circuit 115, an averager 120 and a comparator 130. A signal representative of the power source voltage, $V_s$, is coupled to full wave rectifier 109. The output of full wave rectifier 109 is a signal $/V_s/$ that is coupled to the input of gating circuit 110. The other input of gating circuit 110 is a digital signal from the firing pulse regulator 180. Gating circuit 110 gates the input signal $/V_s/$ to squaring circuit 115 in response to a ONE input signal from the firing pulse regulator 180. The latter occurs each time a firing pulse is generated by firing pulse regulator 180. Accordingly, the output of gating circuit 110 is a signal representative of the instantaneous voltage $V_f$ applied across the fuser 106. As described above, the square of the fuser voltage is proportional to power, so the output signal ($V_f^2$) of squaring circuit 115 is representative of the instantaneous power delivered to the fuser 106. The fuser power signal, $V_f^2$ is coupled to an averaging circuit 120 whose output is a dc signal that is representative of the average power delivered to the fuser 106. The average power signal, $V_{favg}^2$, is coupled to comparator 130. Comparator 130 contains a reference potential representative of a predetermined constant average fuser power level. The output of the averaging circuit 120 is compared with that predetermined reference potential. If the input power signal is below the predetermined level, the comparator 130 generates a request for power signal ($\overline{PWR}$=ZERO). If the input is at or above the reference potential, output of the comparator 130 is a power sufficient signal ($\overline{PWR}$=ONE). The output signal of the comparator 130 is the power monitor output signal and it is connected to firing pulse regulator 180 of digital network 103.

The clock network 101 includes clock pulse generator 150 and zero crossing pulse generator 160, and full wave rectifier 109, all of which are driven by the power source 104. The clock pulse generator has outputs CLK1, CLK2 and $\overline{CLK2}$. These are digital pulse signals that are related to the power supply voltage in the following manner. $V_s$ is a 60 Hz sinusoidal signal, $\overline{CLK1}$ is a 120 Hz digital signal synchronous with $V_s$; CLK2 is a 60 Hz digital signal synchronous with $V_s$; $\overline{CLK2}$ is the inverse of CLK2 and has the same frequency as CLK2. The zero crossing pulse generator has two outputs, CP and CP. The output CP is a series of pulses that are generated as $V_s$ approaches ZERO. $\overline{CP}$ is the inverse of CP. The purpose and function of the foregoing pulse signals, CLK1, $\overline{CLK2}$, CLK2, CP and $\overline{CP}$ will become apparent from the following description of digital network 103.

Digital network 103 comprises three digital circuits, coincidence circuit 170, firing pulse regulator 180 and idle pulse counter 190. Coincidence circuit 170 receives a feedback signal $\overline{PREREG}$ from firing pulse generator 180 and two 60 Hz clock pulse signals, $\overline{CLK2}$ and CLK2. The output of coincidence circuit 170, a signal COINC, is coupled to the input of firing pulse regulator 180 which also receives as inputs a FUSE DISABLE signal, clock $\overline{CLK1}$ and zero crossing pulse signals CP and $\overline{CP}$. The output signal $\overline{PREREG}$ of the firing pulse regulator 180 is fed back to coincidence circuit 170 and to idle pulse counter 190. Idle pulse counter 190 receives the signal $\overline{PREREG}$ as well as signals representative of the fuser temperature (TEMP), the mode of operation (FUSE) and a zero crossing pulse signal, $\overline{CP}$. The output of the idle pulse counter is the firing pulse signal (REG) is coupled to and controls the gate of triac 105.

Under fusing conditions, the signal REG is a series of firing pulses, each one of which is gated out of the idle pulse counter 190 in order to accomplish the following two results: (1) for every $V_s$ half cycle that is gated to fuser 106, the next gated $V_s$ half cycle will be of a polarity opposite to the last gated $V_s$ half cycle and (2) at least every third half cycle of $V_s$ will be gated to fuser 106. The first result is primarily accomplished by the coincidence circuit 170 and the second result is primarily accomplished by firing pulse regulator 180. As mentioned above, coincidence circuit 170 receives a feedback signal $\overline{PREREG}$ which is representative of the last gated half cycle of $V_s$. Coincidence circuit 170 matches the $\overline{PREREG}$ signal with one of the clock pulses, CLK2 or CLK2. It will be recalled that CLK2 and $\overline{CLK2}$ are synchronous with $V_s$. By pairing the $\overline{PREREG}$ signal with one of the clock pulses, the coincidence circuit 170 has a memory of the polarity of the last ac half cycle of $V_f$, the fuser voltage. In response to that memory, coincidence circuit 170 feeds an output control signal COINC to the firing pulse regulator 180 that prevents the further generation of any firing pulses so long as the present half cycle of $V_s$ is of the same polarity as the last half cycle of $V_f$. The firing pulse regulator 180, under control of the COINC signal, will thus never generate firing pulses that will result in two successive half cycles of $V_f$ having the same polarity. Firing pulse regulator 180 is also controlled by the output power request signal $\overline{PWR}$ from comparator 130. In response to a request for power ($\overline{PWR}$=ZERO), the regulator 180 generates a firing pulse for every half cycle of $V_s$. In response to a power sufficient signal ($\overline{PWR}$=ONE), the regulator 180 prevents generation of a firing pulse for one full cycle of $V_s$ and gates every third half cycle of $V_s$ to fuser 106.

Idle pulse counter 190 receives an input signal PREREG from the firing pulse generator 180, a zero crossing pulse CP, a FUSE signal and a thermostat signal TEMP. The output signal of idle pulse counter 190, REG, is coupled to and controls the firing of the gate of triac 150. In the fusing mode of operation, a FUSE signal is generated by the copy control logic (not shown). And, in response to the FUSE signal, the idle pulse counter 190 is disabled and all $\overline{\text{PREREG}}$ pulses generated by the regulator 180 are gated by the idle pulse counter 190 to the triac 105. Accordingly, in the fusing mode of operation, the idle pulse counter 190 acts as a short circuit. As previously discussed, the idle pulse counter 90 provides for operating the fuser 106 in a mode of operation during which less than all of the average power is required. In the idle mode of operation, a thermostat (not shown) at the fuser 106 generates a temperature control signal TEMP when the fuser temperature falls below a predetermined value. The idle pulse counter 190 is set to count either 17 or 65 PREREG pulses before it gates a firing pulse to the gate of triac 105. When the fuser temperature is at or above its predetermined value, the thermostat signal TEMP sets the counter to count 65; when the temperature falls below the predetermined value, the count is decreased to 17 so that firing pulses are gated out more frequently in order to bring the fuser temperature up to its predetermined idle value.

Figure 3:
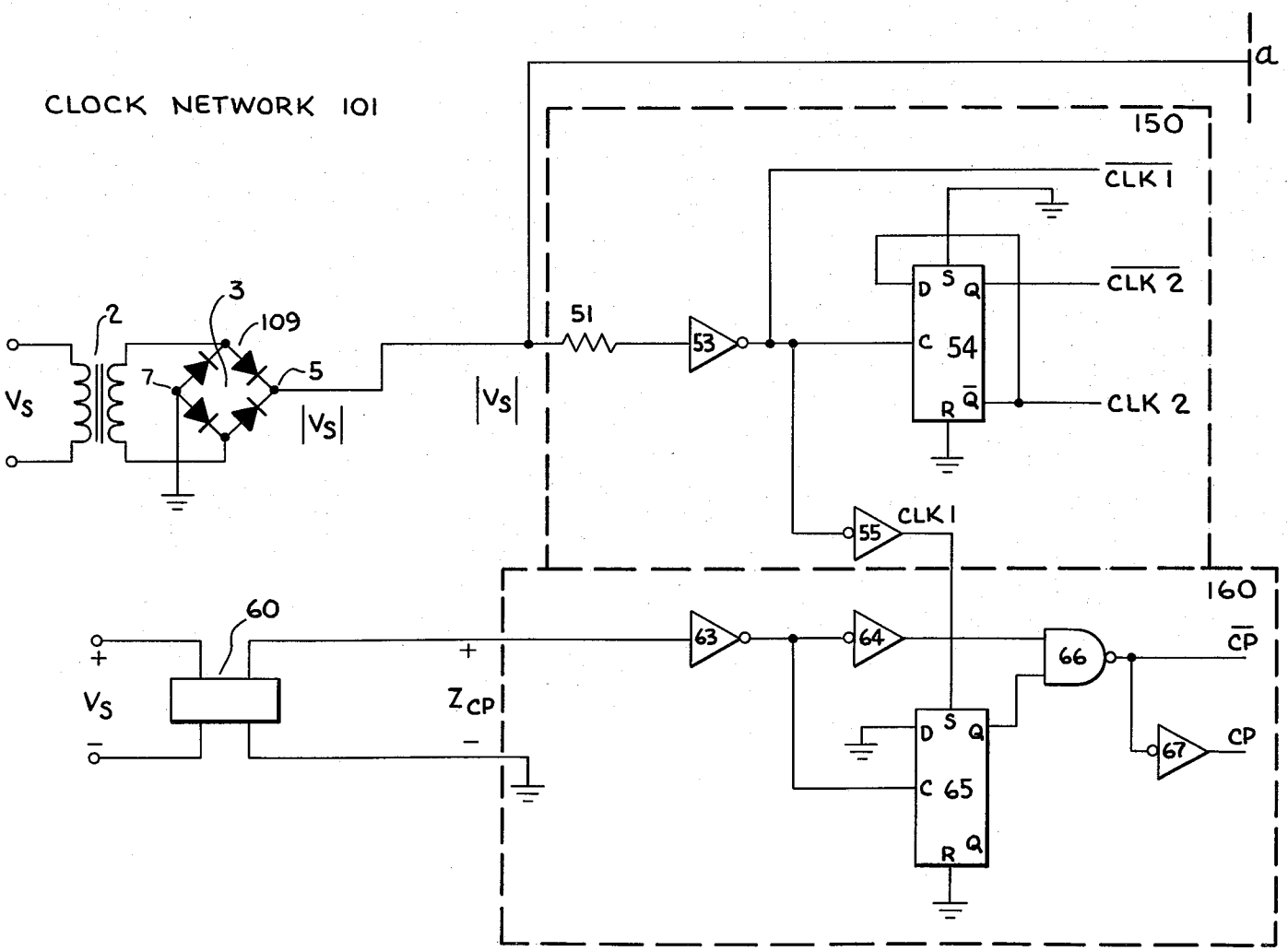
FIG. 3 is a more detailed schematic of the clock monitor network for the preferred embodiment of this invention.

Turning now to the more detailed schematic of the preferred embodiment, there is shown in FIG. 3 the clock pulse generator 150. The input to the clock pulse generator 150 is derived from a full wave rectifier 109 that comprises a voltage transformer 2 and a full wave bridge, 3. The primary side of transformer 2 is coupled across the ac power source 104 and carries the voltage $V_s$. The secondary side of transformer 2 is coupled to a full wave bridge 3 comprising four diodes that are connected together as shown in FIG. 3. The output voltage appearing between nodes 5 and 7 of the full wave bridge is the signal $/V_s/$ which is a fully rectified representation of $V_s$. The voltage $/V_s/$ appears between one side of resistor 51 and ground. The other end of resistor 51 is coupled to inverter 53. The output of inverter 53 is a 120 Hz clock pulse signal $\overline{\text{CLK1}}$. $\overline{\text{CLK1}}$ is connected to the clock line of FF54 which acts as a divide by two counter to yield outputs CLK2 and $\overline{\text{CLK2}}$ that are 60 Hz signals. Thus, CLK2 and CLK2 are representative of the changing polarity of $V_s$.

Zero crossing pulse generator 160 comprises a crossing pulse generator 60 and a shaping network in order to derive the signals CP and $\overline{\text{CP}}$. The crossing pulse generator has an input signal $V_s$ and an output signal $Z_{cp}$. Crossing pulse generators are well known to those skilled in the art and may be constructed from discrete circuit elements or, as in the preferred embodiment, implemented with an integrated circuit such as circuit element CA 3079 distributed by RCA. The output signal $Z_{cp}$ is coupled to inverter 63. The output of inverter 63 is coupled to inverter 64 and to the clock line of FF65. The set terminal of FF65 is coupled to the output of inverter 55 whose output is CLK1. The data line of FF65 is grounded and the Q output is connected to NAND 66. The output of NAND 66 is the input to inverter 67. The output of inverter 67 is a train of pulses which occur each time $V_s$ goes through zero volts and is designated CP. The output of NAND 66 is the inverse of CP, $\overline{\text{CP}}$.

Figure 2:
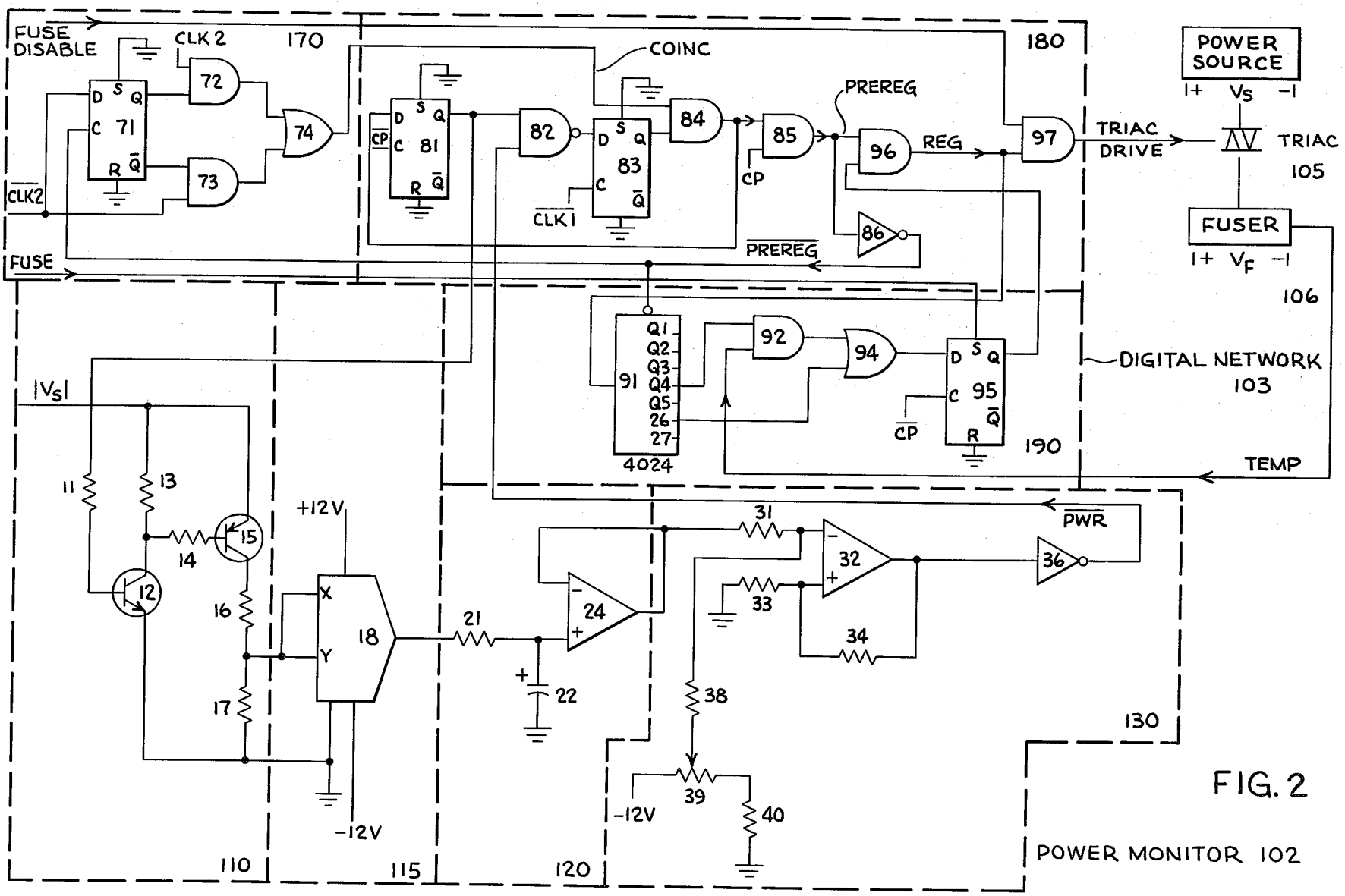
FIG. 2 is a more detailed partial schematic of the digital and power monitor networks for the preferred embodiment of this invention.

A detailed schematic of the power monitor network 102 is shown in FIG. 2. Reading from left to right the first circuit encountered is gating circuit 110 that includes a NPN transistor 12 and a PNP transitor 15. The collector of transitor 12 is coupled to the base of transitor 15 through a resistor 14. The base of transitor 12 is coupled to the Q output of FF81 which provides an input signal representative of each half cycle during which firing pulses are generated. As will become apparent from the following description the output of FF81 is high or ONE so long as the power supply 104 is supplying power to the fuser 106. Since the Q output signal of FF81 controls the base of transistor 12, the transistor will be conductive when 81Q is high and nonconductive when 81Q is low. The power voltage signal $/V_s/$ is coupled directly to the emitter to transistor 15 and to the collector of transitor 12 through resistor 13. Accordingly, the signal $/V_s/$ will be gated to the output of transitor 15 when 81 is high and so the output signal across resistor 17 and is a time varying voltage signal $V_f$ that is representative of the fuser voltage $V_f$.

The signal $V_f$ is subsequently fed into the X and Y inputs of multiplier 18 that comprises squaring circuit 115. The multiplier 18 yields an output signal that is the product of its inputs. Since $V_f$ is on both multiplier inputs, the output signal is $V_f^2$.

The signal $V_f^2$ is next fed into averaging circuit 120 that comprises an RC network 21, 22 and a buffer amplifier 24. It will be recalled that the wave form of V is sinusoidal and so the wave form $V_f^2$ is a sinusoidal at twice the frequency of $V_f$ according to the trigonometric identity $\sin^2 x = \frac{1}{2} - \frac{1}{2}\cos 2x$. In the averaging circuit, the signal $V_f^2$ is time averaged in the RC network 21, 22 to yield a dc level signal $V_{favg}^2$ that is representative of the average power delivered to the fuser during the time interval determined by the time constant of the network 21, 22. The output of the RC network 21, 22 is coupled to a buffer amplifier 24 and then fed into comparator 130.

Comparator 130 comprises an amplifier 32 that has its positive input grounded through resistor 33. The negative input to amplifier 32 is a summing junction comprising two sources. One source is the output of the averaging circuit, $V_{favg}^2$ and the other is a predetermined negative dc level that is fixed by the -12 volt source, potentiometer 39 and resistors 38, 40. When the signal level is less than the predetermined level, the comparator has an output signal indicating that more power is required for the fuser. Likewise, when the signal level of $V_{favg}^2$ is equal to or greater than the predetermined level, the comparator has no output, thus indicating that no additional power is required. The output signal of the comparator is inverted by inverter 36 in order to derive the digital signal $\overline{\text{PWR}}$ which is fed into the digital network. Hence, when $\overline{\text{PWR}}$ is low (ZERO), more power is needed and when $\overline{\text{PWR}}$ is high (ONE), no additional power is needed.

The function of coincidence circuit 180 is to monitor the polarity of the last ac half cycle of $V_s$ that is gated to fuser 106 so that all sequentially gated half cycles will be of opposite polarity. That function is implemented by coupling the COINC signal to one input of AND 84. Since AND 84 is in series with the gate of triac 105, the triac will fire if both inputs to AND 84 are ONE. There is a COINC pulse for every ac half cycle of $V_s$ following a gated half cycle and for every other half cycle thereafter. The latter is best understood by way of illustration with reference to the detailed schematic shown in FIG. 2.

Figure 4:
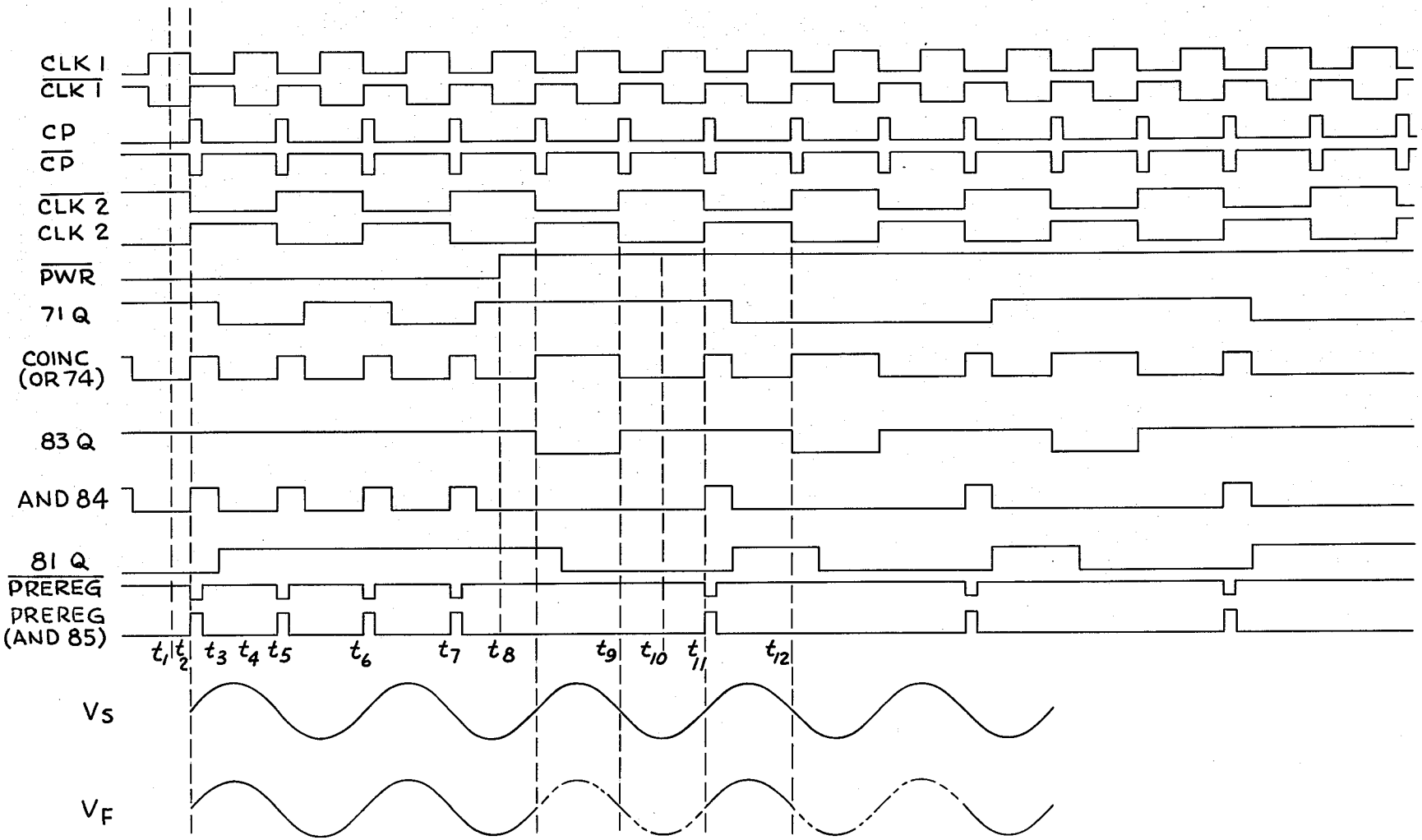
FIG. 4 is a timing diagram showing a set of illustrative network signals.

The more detailed schematic of the digital circuit 103 of the preferred embodiment is shown in FIG. 2. The coincidence circuit 170 comprises a FF71 having its D input coupled to $\overline{CLK2}$ and its C input coupled to the output of inverter 86 that carries the signal $\overline{PREREG}$. The $\overline{Q}$ output of FF71 is connected to one input of AND 72; the other input to AND 72 is CLK2. The Q output of FF71 is connected to one input of AND 73 and $\overline{CLK2}$ is connected to the other AND 73 input. The outputs of both ANDs 72, 73 are connected to the input of OR 74 so there is a COINC signal when either one or both of the outputs of ANDs 72, 73 is ONE. The output of OR 74 is the signal COINC and an illustrative COINC signal is shown in FIG. 4. The FF71 transfers $\overline{CLK2}$ to Q71 after each firing pulse, i.e., when the signal $\overline{PREREG}$ changes from ZERO to ONE.

In operation, the FF71 may be in one of two states: either its $\overline{Q}$ output is ONE or its Q output is ONE. In the first state where 71 Q is ONE, it is readily apparent that the output of AND 72 will be ONE whenever the signal CLK2 is ONE. Hence, in the first state of FF 71, COINC is a signal that is in phase with CLK2. Similarly, in the second state where 71$\overline{Q}$ is ONE, the output of AND 73 will be ONE whenever the signal $\overline{CLK2}$ is ONE. Hence, in the second state, COINC is a signal in phase with CLK2. In either state the input signals to FF71, i.e., CLK2 on 71D and PREREG on 71C, act to change the state of the outputs 71Q, Q. So, if COINC is in phase with $\overline{CLK2}$, when a $\overline{PREREG}$ pulse is generated COINC changes to a signal in phase with $\overline{CLK2}$ and vice-versa. In summary, every time a $\overline{PREREG}$ pulse is generated, the coincidence circuit 170 operates to assure that the next $\overline{PREREG}$ pulse will be generated during the opposite phase of CLK2.

Hence, there is a COINC pulse for every first and third half cycle of $V_s$ following a gated half cycle of $V_s$. As a result, only half cycles of $V_s$ of sequentially opposite polarity may be gated from the power source 104 to the fuser 106.

Firing pulse regulator 180 comprises two FF 81, 83 that are connected through NAND 82. FF81 has its clock input controlled by the zero crossing pulse signal, $\overline{CP}$. The data line of FF81 is coupled to the output of AND 84.

The Q output of FF81 is coupled to one input to NAND 82. The other input to NAND 82 is coupled to the $\overline{PWR}$ signal from the power monitor network 102. The output of NAND 82 is coupled to the data line of FF83; the clock line of FF83 is controlled by the 120 Hz signal, $\overline{CLK1}$. The Q output of FF83 is coupled to AND 84.

The output of AND 84 is coupled to triac 105 through three serially connected ANDs, 85, 96, and 97. Those three ANDs are respectively controlled by the zero crossing pulse signal CP, the idle counter signal IDLE, and a fuser malfunction signal FUSE DISABLE. Under normal fusing operations all of the latter signals will be one and so the output signal of AND 84 will ultimately fire triac 105.

Returning now to FFs 81, 83 it is those two elements that control the number of ac half cycles that are gated to the fuser 106 and, in particular, provide for gating at least every third half cycle of $V_s$ to the fuser 106. When $\overline{PWR}$ is true, i.e., ZERO thereby indicating that more power is needed, the output of NAND 82 is ONE. ONE will be placed on the Q output of FF83 as soon as the 120 Hz clock signal $\overline{CLK1}$ goes high. Hence, so long as there is a request for power from the power monitor network 102, the output of FF83 is ONE and so the output of AND 84 will be controlled by the COINC signal. A COINC pulse will appear at the other input to AND 84, and a PREREG pulse will be gated out thereby firing the triac 105. The signal PREREG will reset the coincidence FF71 which in turn will result in another COINC pulse for the next half cycle of $V_s$, and so every half cycle of $V_s$ will be sequentially gated to the fuser 106 so long as there is a request for power.

From the foregoing explanation, it is apparent that the output of FF81 is always ONE when $\overline{PWR}$ is ZERO. That is so because the input of FF81 is the feedback signal from AND 84. AND 84 is ONE at the time when $\overline{CP}$ goes high, so the Q output of FF81 is ONE when $\overline{PWR}$ is ZERO, and ONE when $\overline{PWR}$ changes from ZERO to ONE.

Accordingly, for a $\overline{PWR}$ signal of ONE and a Q81 output of ONE, the output of NAND 82 is ZERO. That ZERO is clocked through to 83A by the 120 Hz clock $\overline{CLK1}$ when it goes high. With a ZERO on one input to AND 84, the AND 84 output is ZERO and no PREREG pulse is generated for the half cycle of $V_s$ following the change in state of the signal $\overline{PWR}$ from ZERO to ONE. From the foregoing analysis of the coincidence circuit 170, it is known that there will be no coincidence for the next half cycle of $V_s$.

Since there is no COINC signal for the next half cycle of $V_s$, the output of AND 84 is ZERO. That ZERO is fed back to the data input to FF81 where it is clocked to the output Q81 when $\overline{CP}$ goes high. The output of NAND 82 accordingly becomes a ONE. The ONE on the data line of FF83 is clocked through to one input of AND 84 when the 120 Hz clock CLK1 goes high. Accordingly, AND 84 will be ready to gate out a PREREG pulse as soon as there is a COINC signal. The latter occurs during the third half cycle of $V_s$.

When the $\overline{PREREG}$ signal is gated out, COINC is terminated and the coincidence circuit 170 is reset to have a COINC pulse for the very next half cycle of $V_s$ and for every other half cycle thereafter. So long as $\overline{PWR}$ is ONE, the firing pulse regulator 180 will function in the manner described above and every third half cycle of $V_s$ will be gated to the fuser 106.

Idle pulse counter 109 is connected between firing pulse regulator 180 and the gate of triac 105. When active in the idel mode, the idle pulse counter 190 intercepts potential firing pulses before they can reach the triac gate and only passes a predetermined portion of the firing pulses. When a REG pulse is generated, the counter 91 is reset by a feedback signal from AND 96, and pulse counter 91 starts counting again.

In the preferred embodiment, it is desirable to maintain the idle fuser temperature at a fixed level. That temperature is maintained by gating to the triac 105 one of every 17 firing pulses when the fuser temperature is below the fixed level and one of every 65 pulses when the fuser temperature is at or above the fixed level. The idle thermostat signal is connected to one line input of AND gate 92; the other line input is connected to Q4 of counter 91; Q6 of counter 91 is connected to one line input of OR 94. The other input to OR 94 is derived from AND 92. The output of OR 94 is coupled to the data line D of FF95. The clock line of FF95 is the zero crossing pulse signal $\overline{CP}$. The set terminal of FF95 has a FUSE signal input. When the copy machine is in the idle mode, the FUSE signal is ZERO and FF95 transmits the output of the idle pulse counter 190 to triac firing circuit 105. When the FUSE signal is ONE, the Q output of FF95 remains ONE until the FUSE signal returns to zero. This places a ONE at the input to AND gate 96 so that all PREREG pulses gated out of AND 85 will be passed onto the triac firing circuit 105. Thus, when the FUSE signal is ONE, the idle circuit exerts no active control over the firing pulses and the full average constant fusing power can be applied to fuser 106.

Turning now to FIG. 4, there is shown a timing diagram for a typical operation of the invention in the fusing mode. At the time $t_1$, the power monitor 102 has requested power, so the $\overline{PWR}$ signal is ZERO. That signal is coupled to the firing pulse regulator 180 at one of the input lines of NAND gate 82. So, the output of NAND 82 is ONE so long as $\overline{PWR}$ is ZERO, i.e., so long as power is requested by power monitor 102. Accordingly, there is a ONE on the data line of FF83 which is gated to 83Q when the clock line input 83C $\overline{CLK1}$ changes to ONE: The 120 Hz clock signal $\overline{CLK1}$ repeatedly becomes ONE so 83Q is ONE and remains ONE so long as $\overline{PWR}$ is ZERO. Since 83Q is one input to AND 84, the latter will have a ONE output whenever its other input is ONE. The other input for AND 84 is derived from the output of the coincidence circuit 170.

Therefore, the coincidence circuit 170 is the controlling circuit when there is a request for power. As will be shown herein, the coincidence circuit will cause a firing pulse to be generated for every half cycle of V so long as there is a request for power.

In the coincidence circuit 170 at time $t_1$ the Q output of FF71 is ONE. The reason why 170 is ONE will become apparent from the following explanation. Accordingly, there is a ONE on one input to AND 72; the other line input is the clock pulse CLK2 which is zero at time $t_1$. There is also a zero on the line input to AND 73, the other input of which is connected to $\overline{CLK2}$, which is ONE at time $t_1$. At time $t_2$ CLK2 becomes ONE and the output of AND 72 becomes ONE. That ONE is gated through OR gate 74 to the firing pulse regulator, specifically to the second line input to AND 84. It will be recalled that the first line input to AND 84 is already ONE. Accordingly, a ONE is gated out to the first input of AND 85. The second input of AND 85 is the zero crossing pulse signal, CP. At time $t_3$ CP is ONE and a firing pulse is gated out of firing pulse regulator 180.

The firing pulse has to pass through two more AND gates 96, 97 before firing triac 105. It will be recalled that AND gate 96 receives its other line input from idle pulse counter 190 and that the output of idle pulse counter is always ONE when the apparatus is in the fusing mode. The final AND gate 97 has as its other line input a disable signal which is normally ONE. When there is a malfunction, such as a paper jam, the disable signal falls to ZERO thereby preventing any firing pulses from reaching the triac firing circuit 105 until the malfunction is corrected. Hence, under normal conditions, the triac 105 will be fired for at least one half cycle of supply voltage, $V_s$ so long as there is a request for power from the analog network 101.

It will be recalled that inverter 86 is coupled to the output AND 85. The output of inverter 86 carries the signal $\overline{PREREG}$ and is coupled to the coincidence circuit 170, specifically the clock line of FF71. In this manner the output of firing pulse regulator 180 is sampled, inverted and fed back to the coincidence circuit 170 and presents the signal $\overline{PREREG}$ to 71C.

At the time $t_4$, CP is ZERO so the signal PREREG is ZERO and $\overline{PREREG}$ is ONE. The signal $\overline{CLK2}$ is ZERO and that signal has been transferred to 71Q by $\overline{PREREG}$ changing from ZERO to ONE at time $t_3$. With a ZERO at 71Q, the AND gate 72 is disabled. However, the other output of FF71, Q, is ONE. That puts a ONE on one line input to AND 73 and when the other line input $\overline{CLK2}$ goes high at $t_5$, the output of AND 73 becomes ONE, thereby establishing a coincidence for a second firing pulse. That ONE at the output of OR 74 is gated through AND 84 to AND 85 where it awaits the repeated occurrence of another ONE from clock pulse CP. That event occurs at $t_6$ and another $\overline{PREREG}$ firing pulse is gated out. In addition, PREREG, the feedback pulse to FF71, gates the CLK2 signal, (ZERO) to 71Q. At $t_7$, $\overline{CLK2}$ is ONE and so the coincidence circuit 170 is in the same condition at $t_7$ as it was in $t_1$. Accordingly, the earlier assumption of 77Q having a value of ONE is confirmed.

It is thus apparent that so long as there is a request for power, the foregoing operation will be repeated for every half cycle of $V_s$ and every half cycle of $V_s$ will be gated to the fuser 106.

At the time $t_8$ the power monitor stops its request for power and the signal $\overline{PWR}$ rises to ONE. As previously explained, the Q output of FF83 was ONE as long as $\overline{PWR}$ was ZERO. It will remain at ONE until the output of NAND 82 becomes ZERO, and this ZERO is transferred to 83Q by $\overline{CLK1}$.

At $t_9$, a ONE has been gated from the coincidence circuit 170 to one input of AND gate 84. The other input to AND 84 is connected to 83Q. The data line input to FF83 is ZERO because 81Q is a ONE and there is no request for power. 83Q becomes a ZERO at the positive transition of $\overline{CLK1}$.

Since there is a ZERO on the input to AND 84, the output of AND 84 is ZERO, so there will be no firing pulse for the next half cycle of $V_s$.

As mentioned above, the output of AND 84 is also fed back to the data line of FF81. Since the output of AND 84 is ZERO, a ZERO will be on the data line input of FF81 when $\overline{CP}$ next goes high, i.e. at the beginning of the next half cycle of $V_s$, the Q output of FF81 is zero. A ZERO at 81Q is inverted by NAND gate 82 so a ONE is applied to the data line of FF83. At time $t_9$, $\overline{CLK1}$, the clock line input signal of FF83, goes high and the ONE at 83D is gated to 83Q. With a one at 83Q, AND gate 84 is ready to gate out a firing pulse whenever its other line input from the coincidence circuit 170 becomes ONE.

Returning to the coincidence circuit 170, at the time $t_{10}$ the Q output of FF71 is ONE and has been ONE since the last firing pulse was gated out. It will be recalled that the clock line of FF71 is the signal $\overline{PREREG}$. Since no firing pulses have been generated, there has been no change in $\overline{PREREG}$ so the output of FF71 has remained at ONE. Accordingly, NAND gate 72 will allow a coincidence pulse and that occurs when CLK2 becomes ONE.

At time $t_{11}$ there is coincidence, i.e., COINC is ONE, and the output of FF83 is ONE and so a $\overline{PREREG}$ pulse is generated.

Upon generation of the firing pulse at $t_{11}$, the triac 105 is fired for a half cycle. It will be noted that the half cycle of fuser voltage $V_f$ following $t_{11}$ is of a polarity opposite to the last half cycle of fuser voltage and is separated in time from the last half cycle by a full cycle.

Upon termination of the firing pulse when CP goes to ZERO, the signal $\overline{\text{PREREG}}$ will transfer the $\overline{\text{CLK2}}$ signal to the Q output of FF71. Hence, the digital network at time $t_{12}$ closely resembles the situation at time $t_8$ except that the Q output of 71 is reversed. Accordingly, NAND gate 72 will control coincidence and the previously described sequence of events will be substantially repeated. As a result, there will be a series of triac pulses that will fire the triac for one half cycle of $V_s$ after a full cycle delay of $V_s$ and each half cycle of fuser voltage $V_f$ will be of a polarity opposite to the last half cycle.

Accordingly, there has been described a preferred embodiment of this invention for delivering a constant average power from an ac source to a heat source that includes an illustrative application of the principles of this invention. Other embodiments may be devised by those skilled in the art without departing from the spirit and scope of this invention.

In the foregoing description of the preferred embodiment, firing pulse signal PREREG has been shown coupled directly to the gate of triac 106. Those skilled in the art will recognize that while the pulse signal PREREG will operate the triac gate for one half cycle, it is also possible and often desirable to interpose a gating circuit between the pulse signal PREREG and the triac 106. A typical gating circuit comprises a pulse transformer that has its primary side coupled to the signal PREREG and its secondary side coupled to the triac gate.

While the foregoing description of the preferred embodiment included a triac 105 interposed between the power source 104 and the fuser 106, those skilled in the art would be able to substitute other firing devices or networks that would accomplish the same result as the triac 106, i.e., gating an ac half cycle in response to receipt of a firing signal from firing pulse regulator 180. For example, two SCRs appropriately connected would function in the same manner as triac 106.

Moreover, while the foregoing description of the preferred embodiment of the average power control apparatus of this invention has been described in connection with the control of power to a focused radiant energy fuser in an electrophotocopy machine, those skilled in the art will appreciate that the invention may be used to control heat sources other than fusers.

What is claimed is:

1. In an electrophotocopy machine adapted to be connected to a source of supply of ac power and including a fuser, apparatus for controlling the power supplied to the fuser, said power controlling apparatus comprising:

a. a gate interposed between the source and fuser and responsive to respective firing signals for gating power to the source;

b. a clock network including means for generating a zero-crossing signal in response to each change of polarity of voltage of said source;

c. a fuser power monitoring network including means coupled to the source and fuser for generating a signal representing the average level of power gated to the source, said fuser power monitoring network including means for comparing said average power level to a desired level and generating a digital power request signal when the power level is not greater than said desired level; and d. a digital network including a coincidence circuit coupled to the clock and power monitoring networks for controlling the polarity of half cycles of power gated to the fuser, the coincidence circuit including means for comparing respective half cycles of power gated to the fuser with respective half cycles available for gating and generating a coincidence signal when the polarity of the next half cycle of power is opposite to the last gated half cycle; and said digital network including a regulating circuit for controlling the number of opposite half cycles of power gated to the fuser, the regulating circuit responsive to the power request signal and responsive to respective coincidence signals for generating firing pulses to timely gate at least one of each successive three full half cycles of power to said fuser such that average power which is free of any dc signal component and not less than one-third of the available power is delivered to said fuser.

2. The apparatus according to claim 1 including an idle pulse counting circuit responsive to the temperature of said fuser, said counting circuit cooperative with said regulating circuit for coupling a predetermined number of firing pulses to said gating circuit when said temperature of said fuser is not greater than a predetermined level.

* * * * *